US006259063B1

(12) United States Patent
Lintner et al.

(10) Patent No.: US 6,259,063 B1
(45) Date of Patent: Jul. 10, 2001

(54) OVEN WITH COOLING-AIR FAN AND FAN-HOLDING PART FOR AN OVEN

(75) Inventors: Kurt Lintner, Nussdorf; Klemens Roch, Trostberg, both of (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 0 days.

(21) Appl. No.: 09/132,221

(22) Filed: Aug. 11, 1998

(30) Foreign Application Priority Data

Aug. 11, 1997 (DE) ..... 197 34 767

(51) Int. Cl.[7] ..... H02K 5/16; A21B 3/04; F27D 7/04

(52) U.S. Cl. ..... 219/399; 219/400

(58) Field of Search ..... 219/399, 400; 126/219, 193; 165/104.33, 104.34; 432/152, 250

(56) References Cited

PUBLICATIONS

Klement et al, DE 2846277 Patent Abstract, Apr. 30, 1980.*

* cited by examiner

*Primary Examiner*—Joseph Pelham
(74) *Attorney, Agent, or Firm*—Herbert L. Lerner; Laurence A. Greenberg; Werner H. Stemer

(57) ABSTRACT

An oven includes a cooking chamber. A cooling-air fan is disposed outside the cooking chamber. An intake opening leads to the cooling-air fan and an exhaust duct leads from the cooling-air fan into the open air. A holding section associated with the exhaust duct has a bearing plate for a motor of the cooling-air fan, in order to reduce mounting expenditures.

10 Claims, 2 Drawing Sheets

OVEN WITH COOLING-AIR FAN AND FAN-HOLDING PART FOR AN OVEN

BACKGROUND OF THE INVENTION

Field of the Invention

The present invention relates to an oven with a cooking chamber and a cooling-air fan which is disposed outside the cooking chamber, has an intake opening and is connected to an exhaust duct that opens out into the free air.

Such an oven is known from German Utility Model G 88 06 276.7, in which a cooling-air fan of standard construction can be attached to a connection opening of the exhaust duct.

SUMMARY OF THE INVENTION

It is accordingly an object of the invention to provide an oven with a cooling-air fan, and a fan-holding part for an oven, which overcome the disadvantages of the heretofore-known devices of this general type and which reduce the cost of the cooling-air fan.

With the foregoing and other objects in view there is provided, in accordance with the invention, an oven, comprising a cooking chamber; a cooling-air fan disposed outside the cooking chamber; a motor for the cooling-air fan; an intake opening leading to the cooling-air fan; an exhaust duct leading from the cooling-air fan into open air; and a holding section associated with the exhaust duct and having a bearing plate for the motor.

As a result, it is possible to dispense with the use of a second bearing plate directly at the motor, which is otherwise required. Since the exhaust duct is at least partially made from plastic, the bearing plate can be realized in a particularly inexpensive manner using plastic.

In accordance with another feature of the invention, the holding section is constructed as a separate fan-holding part which can be attached to the exhaust duct. As a result, the assembly outlay can be reduced significantly in particular for axial-fan motors. It is now possible to completely preassemble the cooling-air fan with a fan wheel and to supply it as a complete, tested structural unit for installation in the oven. It is not necessary for the exhaust shaft to be made from a plastic which may be of a higher grade, in order to be able to perform the bearing function. It is rather only necessary for the fan-holding part to be made of such a plastic. Advantageously, the holding section including the fully assembled cooling-air fan may be attached to the exhaust duct by using latch-in connections without further effort.

In accordance with a further feature of the invention, the fan-holding part has a protective sleeve in which the fan wheel is rotatably accommodated. As a result, the fan wheel is protected during transport in a simple manner. In addition, the protective sleeve may also contribute to sealing a transition section between the fan-holding part and the exhaust duct. Additionally, an attachment device for attaching the exhaust duct to the oven may be provided on the fan-holding part.

In accordance with an added feature of the invention, in order to keep the structure of the exhaust duct/cooling-air fan unit as simple as possible while at the same time maintaining a variety of possible uses, the fan-holding part has, in addition to the intake opening, an auxiliary intake opening, through which air or the like can additionally be fed to a reduced-pressure region of the cooling-air fan. This can be utilized, for example, together with the cooling-air fan, to extract vapors from the cooking chamber when required and convey them through the exhaust duct into the free air.

In accordance with an additional feature of the invention, the fan-holding part is formed of a suitable plastic material, e.g. of thermoplastic polyester which is dimensionally stable up to approximately 200° C. In contrast, the exhaust duct may be produced, for example, from the less expensive ABS plastic.

With the objects of the invention in view, there is also provided a fan-holding part for use in such an oven.

Other features which are considered as characteristic for the invention are set forth in the appended claims.

Although the invention is illustrated and described herein as embodied in an oven with a cooling-air fan and a fan-holding part for an oven, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
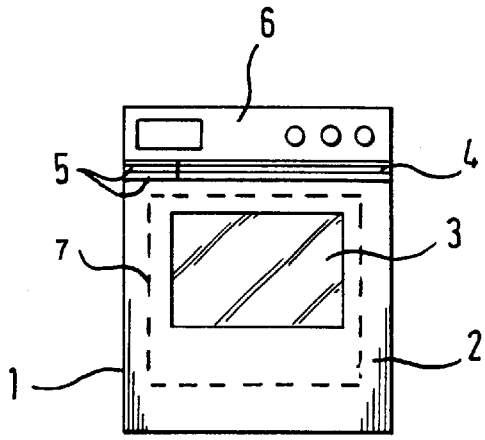
FIG. 1 is a diagrammatic, front-elevational view of an oven.

Referring now to the figures of the drawings in detail and first, particularly, to FIG. 1 thereof, there is seen a diagrammatically illustrated front of an oven according to the invention. A non-illustrated oven muffle, which delimits a cooking chamber 7, is disposed in an oven housing 1. The cooking chamber 7 is accessible from the front and can be closed off by an oven door 2 with a viewing window 3. A ventilator strip 4, with ventilator slats 5 which are directed obliquely downwards, is situated above the oven door 2. A ventilation device illustrated and described below is disposed above the cooking chamber 7, behind the ventilator strip 4 in the oven housing 1. A control panel 6 of the oven, including diagrammatically depicted operating and display elements, is situated above the ventilator strip 4.

Figure 2:
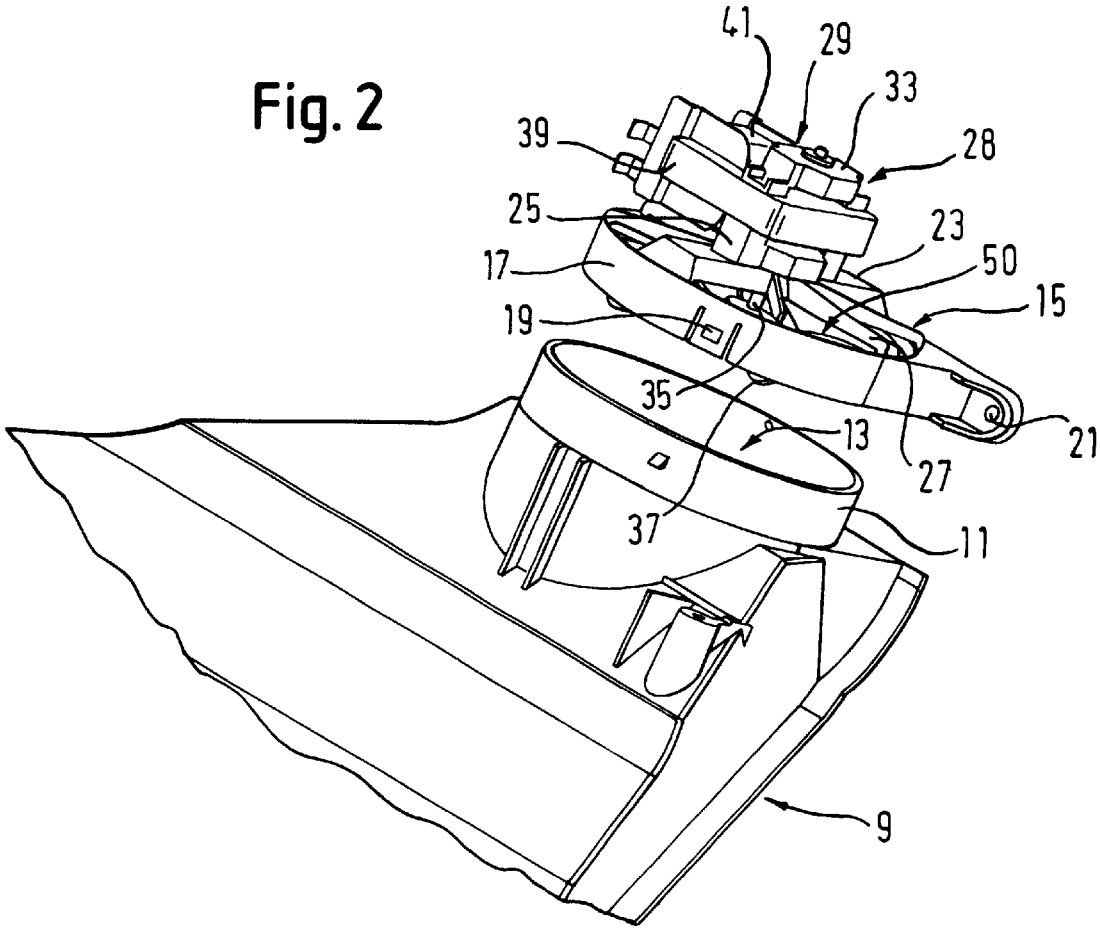
FIG. 2 is a fragmentary, perspective view of a portion of an exhaust duct and a fan-holding part with a cooling-air fan before assembly in accordance with a first exemplary embodiment.

FIG. 2 shows a section of the ventilation device. An exhaust duct 9, which widens in the manner of a funnel towards the ventilator strip 4 and is made of ABS plastic, is mounted on a non-illustrated metal base plate. In order to increase the sealing power of the exhaust duct, a sealing lip may be injection-molded on the underside of the plastic part. The sealing lip bears tightly against the metal base plate. When the ventilation device has been mounted on the cooking chamber 7, a connection sleeve 11 of the exhaust duct 9 projects obliquely upwards and a connection opening 13 thereof is disposed at an entry (in terms of flow) to the exhaust duct 9. A support part or holding section 15 made of thermoplastic polyester can be attached to an upper end section of the connection sleeve 11. For this purpose, the support or fan-holding part 15 has a support-part ring 17 which has openings 19 for latching hooks in its flat side wall. The openings interact with latching lugs on the connection sleeve 11. Moreover, two mutually opposite attachment eyelets 21 are formed on the support-part ring 17. The attachment eyelets 21 can be used to attach the complete ventilation device inside the oven, after the support part 15 has been latched to the exhaust duct 9. A stable transverse support 23 is formed integrally in the center of the support-part ring 17. A top part of the transverse support 23 is shaped as a first bearing plate 25 for a motor 29 which is described below. In order to provide further stabilization and to prevent contact, webs 27 which are formed integrally with the support-part ring 17 and are disposed in the form of spokes, are provided between the transverse support 23 and an inner wall surface of the support-part ring 17. An intake opening 50 for sucking air into the exhaust duct 9 is formed between the webs 27.

A cooling-air fan 28 is attached to the support part 15 before the latter is attached to the exhaust duct 9. In a manner which is known per se, the motor 29 of the fan 28 has a second bearing plate 33, a motor shaft 35, a fan wheel 37, a stator core 39 and a stator winding 41. The motor shaft 35 is mounted in the first bearing plate 25 of the support part 15 and the second bearing plate 33 of the motor 29. The fan wheel 37, which is known per se, is mounted on the motor shaft 35 which projects through a bore in the transverse support 23. This is particularly simple due to the configuration of the support part 15. The structural unit which has been prefabricated in this way and can be tested, including the support part 15 and the cooling-air fan 28, can then be attached to the exhaust duct 9 in a manner which is beneficial in terms of assembly techniques.

Figure 3:
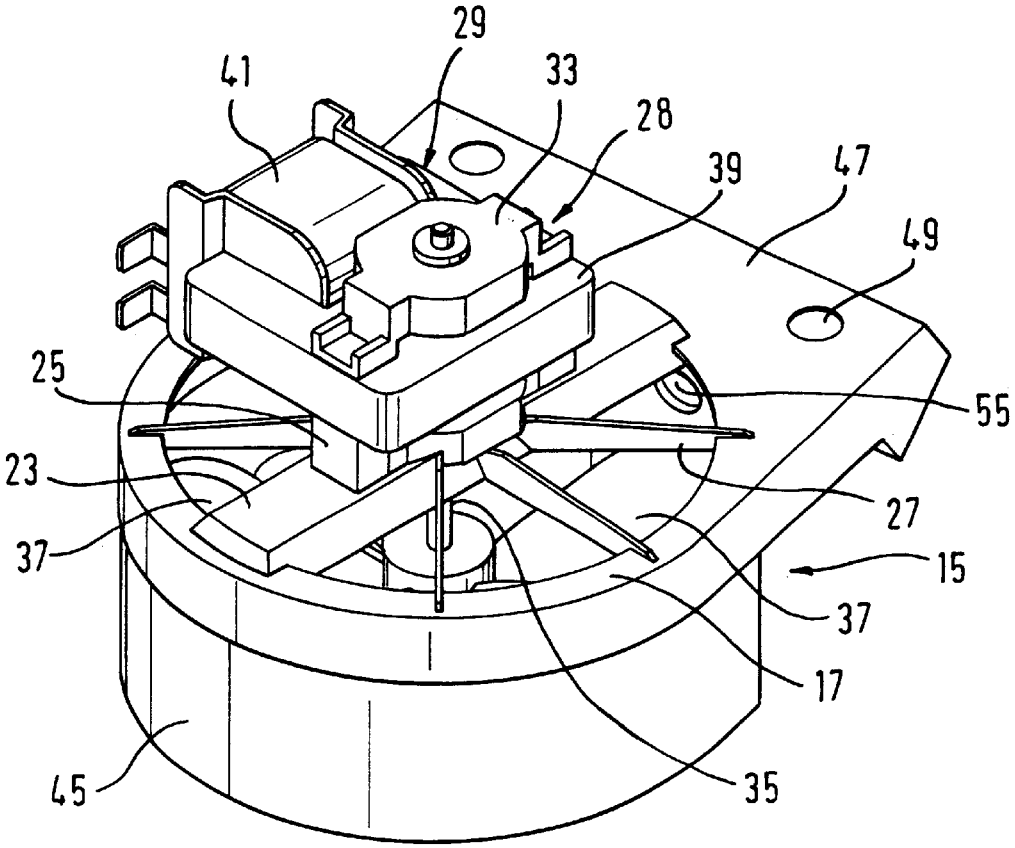
FIG. 3 is a perspective view of a section of the exhaust duct and the fan-holding part with the cooling-air fan before assembly in accordance with a second exemplary embodiment.
Figure 4:
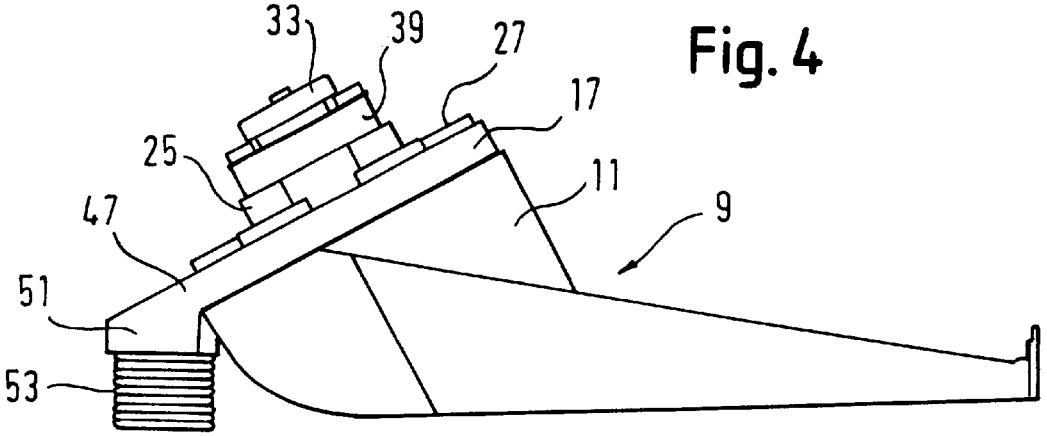
FIG. 4 is a side-elevational view of the fully assembled cooling-air fan/exhaust duct unit in accordance with the second exemplary embodiment.

FIG. 3 and 4 show a ventilation device in accordance with a second exemplary embodiment. For reasons of simplicity, identical reference numerals are used where possible. Unlike the first exemplary embodiment, the support-part ring 17 has a support-part sleeve 45 as an extension. The height of the support-part sleeve 45 is selected in particular in such a way that a suitable protection is provided for the fan wheel 37 during transport. Furthermore, the support-part sleeve 45 may also serve to improve the guidance of air inside and into the exhaust duct 9. For reasons of simplicity, an attachment device for attaching the support part 15 to the exhaust duct 9 is not shown. The support-part ring 17 merges into an attachment plate 47 in a rear-side end region of the support part 15. Two attachment openings 49 for attaching the support part 15 and, if appropriate, at the same time the exhaust duct 9, in the oven, are provided in the attachment plate. As is shown in FIG. 4, a hose connection piece 51 is formed on the underside of the attachment plate 47 and a vapor hose 53, which is known per se, can be fitted onto the connection piece. An intake opening 55 of the connection piece opens out in an intake region of the cooling-air fan 28 above the fan wheel 37. As a result, if required, it is also possible by using the ventilation device shown to extract vapors from the cooking chamber 7 using the cooling-air fan 28 and to blow those vapors out of the oven housing 1 from the ventilator strip 4, once they have been mixed with cooling air in the exhaust duct 9.

We claim:

1. An oven, comprising:

a cooking chamber;

a cooling-air fan disposed outside said cooking chamber, said fan having a motor;

an intake defining an opening leading to said cooling-air fan;

an exhaust duct leading from said cooling-air fan into open air; and at least one plastic holding section associated with said exhaust duct, said holding section having a bearing plate for said motor, said holding section and said bearing plate being formed in one piece.

2. The oven according to claim 1, wherein said holding section is a separate fan-holding part to be attached to said exhaust duct.

3. The oven according to claim 2, wherein said cooling-air fan has a fan wheel, and said fan-holding part has a protective sleeve in which said fan wheel rotates.

4. The oven according to claim 2, wherein said cooling-air fan has a reduced-pressure region, and said fan-holding part has, in addition to said intake opening, an auxiliary intake opening, for additionally feeding air to said reduced-pressure region.

5. The oven according to claim 2, wherein said fan-holding part is formed of a material suitable for operation at temperatures of over approximately 200° C.

6. In an oven including a cooking chamber, a cooling-air fan disposed outside the cooking chamber, the fan having a motor, an intake defining an opening leading to the cooling-air fan, and an exhaust duct leading from the cooling-air fan into open air, a fan-holding part comprising:

a plastic holding section associated with said exhaust duct, said holding section having a bearing plate for a motor, said holding section and said bearing plate being formed in one piece.

7. The fan-holding part according to claim 6, including a ring for attaching the fan-holding part to the exhaust duct.

8. The fan-holding part according to claim 6, including a protective sleeve in which a fan wheel of the cooling-air fan rotates.

9. The fan-holding part according to claim 6, including an auxiliary opening, in addition to the intake opening, for additionally feeding air to a reduced-pressure region of the cooling-air fan.

10. The fan-holding part according to claim 6, wherein the fan-holding part is formed of a material suitable for operation at temperatures of over approximately 200° C.

* * * * *